US010676161B1

(12) United States Patent
Loehrig

(10) Patent No.: US 10,676,161 B1
(45) Date of Patent: Jun. 9, 2020

(54) BOAT TETHERING AND LAUNCHING DEVICE

(71) Applicant: Steve Loehrig, Boynton Beach, FL (US)

(72) Inventor: Steve Loehrig, Boynton Beach, FL (US)

( * ) Notice: Subject to any disclaimer, the term of this patent is extended or adjusted under 35 U.S.C. 154(b) by 0 days.

(21) Appl. No.: 16/250,751

(22) Filed: Jan. 17, 2019

(51) Int. Cl.
*B63B 21/20* (2006.01)

(52) U.S. Cl.
CPC ..... *B63B 21/20* (2013.01); *B63B 2021/203* (2013.01)

(58) Field of Classification Search
CPC ..... B63B 21/20; B63B 2021/203; B63B 2021/005
See application file for complete search history.

(56) References Cited

U.S. PATENT DOCUMENTS 4,426,908 A * 1/1984 Ullmann ..... B60R 9/048 114/253
5,205,803 A * 4/1993 Zemitis ..... A63B 21/0552 482/121
2001/0032576 A1* 10/2001 Brown ..... B63B 21/00 114/230.1
2004/0177797 A1* 9/2004 Severdija ..... B63B 21/00 114/230.2
2005/0061223 A1* 3/2005 Carr ..... B63B 21/00 114/230.2
2013/0340665 A1* 12/2013 Merrill ..... B63B 21/20 114/230.24
2017/0283009 A1* 10/2017 Harrod ..... B63B 21/502

* cited by examiner

*Primary Examiner* — Anthony D Wiest
(74) *Attorney, Agent, or Firm* — Andrew F. Young, Esq.; Lackenbach Siegel, LLP

(57) ABSTRACT

A boat tethering and launching system and device including a first longitudinally extending length of tethering material having a first modulus of elasticity, the first length of tethering material having a first end and a second end; a second longitudinally extending length of tethering material having a second modulus of elasticity, the second length of tethering material having a first section, a second section, and a third section, the second end of the first length of tethering material being coupled to the first section of the second length of tethering material; a biasing member having a length that is shorter than that of the second section of the second longitudinally extending length of tethering material, the biasing member having a third modulus of elasticity; and wherein each of the first, second, and third moduli of elasticity have different values.

1 Claim, 3 Drawing Sheets

BOAT TETHERING AND LAUNCHING DEVICE

BACKGROUND

Technical Field

The present disclosure relates generally to a tethering and launching system and device for a boat, and more particularly to a tethering and launching system that includes a tethering member that has a biasing member that facilitates reliable and repeatable extension and retraction of mooring lines and locking of the mooring line to another subject, e.g., a fixed object such as a dock or a pier.

Description of the Related Art

Loading of a boat onto the trailer may be accomplished through various mechanical means. For example, the ramp typically may a winch or a hauling or lifting device consisting of a tethering material, e.g., a rope, cable or chain winding around a rotating drum that is turned by a crank or by a motor to pull the boat along the ramp and to load the boat onto the trailer such that it can be transported to the shore.

When launching a boat (or other maritime vessel), typically a trailer, which may include a ramp, on which the boat has been loaded is positioned alongside the edge of a body of water or shore. A tethering material may be secured to a fixed location relative to the shore such as to the trailer which is positioned on the shore and to the bow cleat of the boat. The incline of the ramp causes the force of gravity to move the boat along the ramp into the water. Once the boat is in the water and the tethering material is fully extended, the tethering material becomes taut and prevents the boat from moving farther away from the shore.

the rate at which the boat slides or moves down the ramp is a factor of the frictional forces between the boat and the ramp which would necessarily limit the rate at which the boat can move along the ramp depending on the strength of the rope. The length of the rope, the angle of the ramp, and such factors all affect the ultimate force that the rope will have to withstand. It is important to be cognizant that the tethering material has a maximum load or force that it can withstand prior to failure. Accordingly, conventionally, if the tethering material extends too quickly, the slack in the tethering material will become too great such that the tethering material is no longer hindering the boat from sliding down the ramp and causing the boat to accelerate to a greater speed due to the force of gravity. Once the boat has traveled a sufficient distance to cause the tethering material to become taut, the boat may then exert a force that is too great for the tethering material to withstand without failing or breaking.

Furthermore, even if the tethering material can withstand the force of an accelerating boat as it is launched uncontrolled off of the ramp, the sudden stop of the boat is disadvantageous because it would still exert unnecessary wear upon equipment and might still result in damage or discomfort to objects and people who might be onboard the boat.

Safely mooring a boat to a pier or a dock typically requires that the boat be equipped with sufficient length of mooring material, e.g., rope or cable to facilitate securing the boat in a variety of conditions. Once the boat is launched into the water, it is still typically moored or secured to the shore via a pier or a dock unless embarking upon a trip. As conventional ropes, cables, and chains do not have any or much 'give', as the boat rocks in the waves of the water, the ropes, cables or chains securing the boat to the shore repeatedly alternate between a taut and a slack condition which may be jarring especially in rocky waters.

Ideally, the safe mooring of vessels to docks, piers or other vessels requires that the vessel or dock be equipped with sufficient lengths of tethering material, e.g. mooring rope or cable to enable the vessel to be secured and maintained out of harm's way under a variety of mooring conditions and the tethering material should be easily adjustable in length so as to satisfy various condition. Furthermore, the tethering material should be easily stowed in a safe and orderly fashion so that it does not become a hazard to passengers or other equipment. A mechanism which can be affixed to a vessel or the adjacent mooring structure and that has a relatively small form factor would also be preferable.

In addition, a tethering material that would dampen or soften the stopping of the boat as the tethering material is drawn toward a taut condition from a slacker condition and/or vice versa such that the boat is not suddenly accelerated or decelerated that would otherwise cause damage or discomfort to equipment or passengers, respectively.

With respect to ropes, it is noted that ropes may have a small degree of 'give' depending on how the ropes are braided. There are many designs for weaving a rope. Clusters of individual fibers form the strands. Several strands are woven in a pattern to form the rope. And, these ropes themselves can be used as strands and woven to make even larger ropes. Differently braided and twisted ropes have different properties and handle stresses and forces that may be applied to them differently.

Different types of tethering materials may include, for example: a three-strand or four-strand twisted rope; a single braid; a hollow braid; a solid braid; a double braid; a kernmantle; a Z-Twist (Right Hand Lay); and an S twist (Left Hand Lay). Each has different characteristics and responses to the application of force to an end of the rope. For example, a three-strand twisted rope is often used in boating for mooring. Unlike the various braids which follow, twisted rope under strain imparts a rotational force at each end. For heavy lifting, non-rotational ropes are preferable. More recently, in marine and industrial use, "Hollow Braid" has been used to describe modern high-modulus braided 8-, 12-, and 16-strand ropes (and less commonly 20- and 24-strand). In these ropes the strands commonly progress around in pairs. Loose braiding and small braid angle enhance strength by minimizing kinking and compression of the strands.

The ultimate strength of the rope's fibers could only be realized if every fiber was straight, parallel to the rope's axis, and equally loaded. These desirable objectives conflict with more practical requirements such as resistance to abrasion and ability to knot and splice. The fibers in loosely woven Hollow-Braid rope are all at roughly the same angle to the axis and this angle is quite small. Twisting and tighter braiding provide other desirable properties but they increase the fiber angle, which reduces strength.

Depending on the materials from which the rope is manufactured, the rope will have various performance attributes. For example, the breaking strain of a rope is the force required to break the rope under controlled conditions. Also for example, Young's Modulus (Modulus of Elasticity) measures the force required to stretch rope fibers. Young's Modulus (M) describes tensile elasticity, or the tendency of an object to deform along an axis when opposing forces are applied along that axis; it is defined as the ratio of tensile stress to tensile strain. It is often referred to simply as the elastic modulus.

High values indicate large forces are required, i.e., high modulus means little elasticity. Although elasticity is highly desirable in some applications, e.g., an anchor rode or a dynamic climbing rope, elsewhere it is a disadvantage. Modern ropes with little elasticity are known as "High Modulus" ropes. In other words, Young's modulus measures the resistance of a material to elastic (recoverable) deformation under load. A stiff material has a high Young's modulus and changes its shape only slightly under elastic loads (e.g. diamond). A flexible material has a low Young's modulus and changes its shape considerably (e.g. rubbers).

Young's Modulus (M): M is calculated from the load required to produce a given extension. The load has to take into account both the force (F) and the cross section area of the fiber (A) and can be expressed as F/A. This force has to be compared to the amount of extension (E) that it causes compared to the original length (L) and can be expressed as E/L:

$$M=(F/A)/(E/L) \text{ or } FL/EA$$

More simply, showing the result for a theoretical extension of 100% makes E and L equal and simplifies the equation to force per unit area:

$$M=F/A$$

A high value for the Young's Modulus is often confused with high strength. For rope this confusion is easily explained: new high modulus fibers are usually very strong. The two properties are, however, unrelated. Nylon, for example, is a low modulus fiber with considerable strength. Nylon is a generic designation for a family of synthetic polymers, based on aliphatic or semi-aromatic polyamides. Nylon is a thermoplastic silky material that can be melt-processed into fibers films or shapes. Nylon was the first commercially successful synthetic thermoplastic polymer. That is, nylon does not stretch or shrink. Nylon is also a resilient fabric whether wet or dry. The higher the modulus of elasticity, the less the elasticity or stretchability of the material.

While ropes might have some degree of stretchability, they are considerably limited in the extent to which they can stretch nor do they provide any biasing forces to return to an initial state after having been stretched. In addition, the fibers in loosely woven Hollow-Braid rope are all at roughly the same angle to the axis and this angle is quite small. Twisting and tighter braiding provide other desirable properties but they increase the fiber angle, which reduces strength. Also as discussed above, while a three-strand twisted rope is often used in boating for mooring, a twisted rope can impart a rotational force at each end and may not have much stretchability along its length. While once moored in certain conditions a twisted rope may have desirable performance characteristics, when launching a boat, the lack of stretchability in the rope may be problematic as the rope may fail or break. A hollow braid which does have some, even if limited, ability to stretch when pulled may be desirable when launching a boat as the pull force exerted upon the rope from the launching of the boat would be typically be greater than in most mooring condition. However, hollow braid ropes are not without their disadvantages. The fibers in loosely woven Hollow-Braid rope are all at roughly the same angle to the axis and this angle is quite small. Twisting and tighter braiding provide other desirable properties but they increase the fiber angle, which reduces strength.

It would be desirable if there were a device including a tethering material that can have more than one performance characteristic. That is, it would be desirable if the tethering material could stretch when needed while being strong. It would also be desirable if the device including the tethering material could control the rate by which the boat is being launched without depending on a human operator to manually deploy a tethering material from a drum at a rate which might not be ideal and may lead to injury or damage. Conventionally, there is no device and/or tethering material that performs ideally under all circumstances and that can control the rate of a launch of a boat into a body of water. The present invention as will be discussed below addresses at least some of the limitations of the conventional devices for launching and/or mooring boats.

It should be understood that nothing in the background section shall be construed as an admission of prior art unless otherwise noted and the examples that were discussed have been provided so as to provide a better understanding of the problems addressed by the current invention.

SUMMARY

The present disclosure relates to a boat tethering and launching system, which may include a boat tethering and launching device including: a first longitudinally extending length of tethering material having a first modulus of elasticity, the first length of tethering material having a first end and a second end; a second longitudinally extending length of tethering material having a second modulus of elasticity, the second length of tethering material having a first section, a second section, and a third section, the second end of the first length of tethering material being coupled to the first section of the second length of tethering material; and a biasing member having a length that is shorter than that of the second section of the second longitudinally extending length of tethering material, the biasing member having a third modulus of elasticity, wherein each of the first, second, and third moduli of elasticity have different values.

The above and other aspects, features and advantages of the present disclosure will become apparent from the following description read in conjunction with the accompanying drawings, in which like reference numerals designate the same elements.

BRIEF DESCRIPTION OF THE DRAWINGS

A further understanding of the present disclosure can be obtained by reference to a preferred embodiment set forth in the illustrations of the accompanying drawings. Although the illustrated preferred embodiment is merely exemplary of methods, structures and compositions for carrying out the present disclosure, both the organization and method of the disclosure, in general, together with further objectives and advantages thereof, may be more easily understood by reference to the drawings and the following description. The drawings are not intended to limit the scope of this disclosure, which is set forth with particularity in the claims as appended or as subsequently amended, but merely to clarify and exemplify the disclosure.

For a more complete understanding of the present disclosure, reference is now made to the following drawings in which.

DETAILED DESCRIPTION

Figure 1:
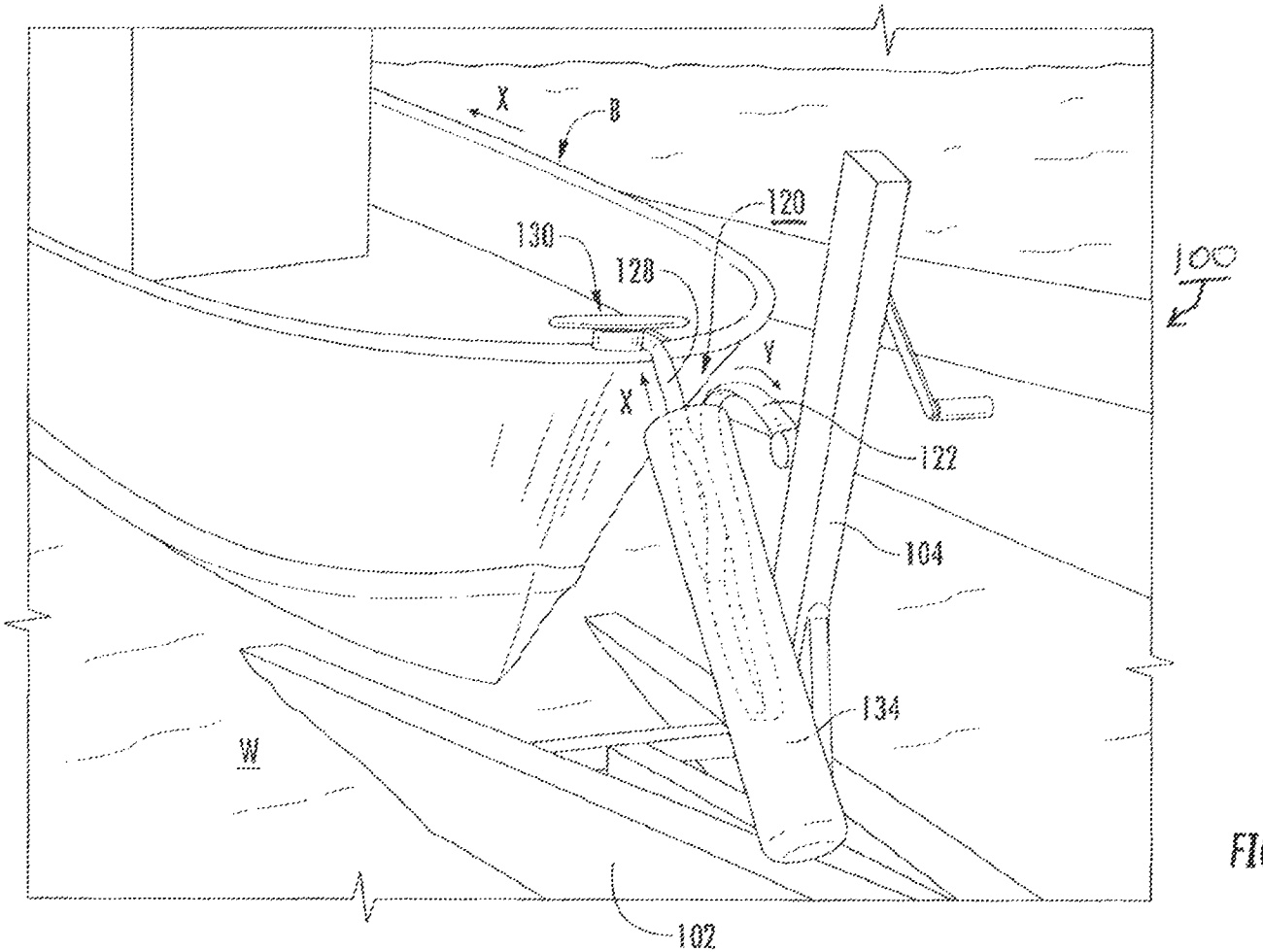
FIG. 1 is a perspective view of a both tethering and launching system including a boat tethering device in accordance with an aspect of the present disclosure as a boat is being launched from a trailer into a body of water as the boat tethering device is being deployed.

As required, a detailed illustrative embodiment of the present disclosure is disclosed herein. However, techniques, systems, compositions and operating structures in accordance with the present disclosure may be embodied in a wide variety of sizes, shapes, forms and modes, some of which may be quite different from those in the disclosed embodiment. Consequently, the specific structural and functional details disclosed herein are merely representative, yet in that regard, they are deemed to afford the best embodiment for purposes of disclosure and to provide a basis for the claims herein, which define the scope of the present disclosure.

Reference will now be made in detail to several embodiments of the disclosure that are illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as top, bottom, up, down, over, above, below, etc., or motional terms, such as forward, back, sideways, transverse, etc. may be used with respect to the drawings. These and similar directional terms should not be construed to limit the scope of the disclosure in any manner.

Figure 2:
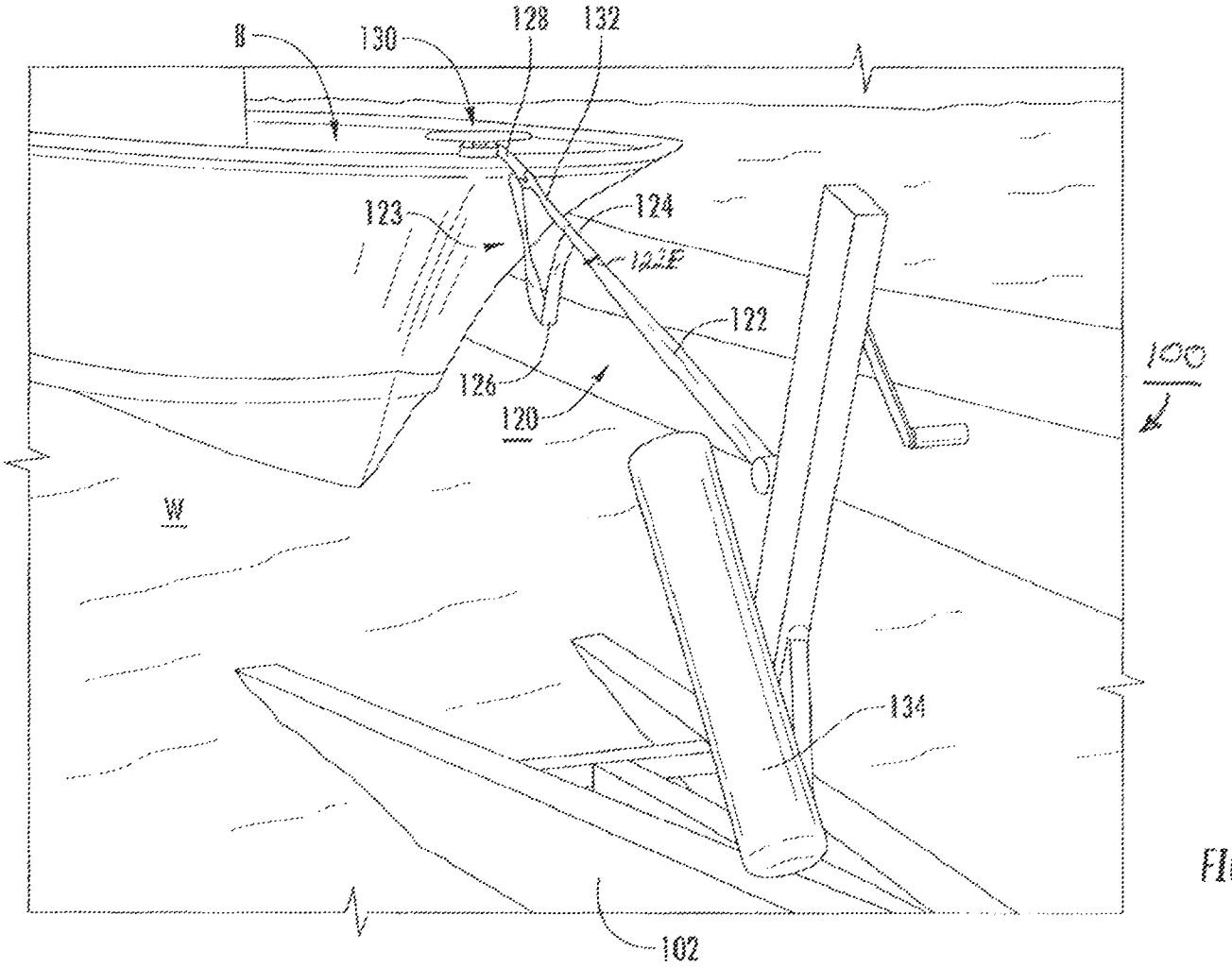
FIG. 2 is a perspective view of a boat tethering and launching system in accordance with an aspect of the present disclosure shown in use and with the boat tethering device in a first condition.
Figure 3A:
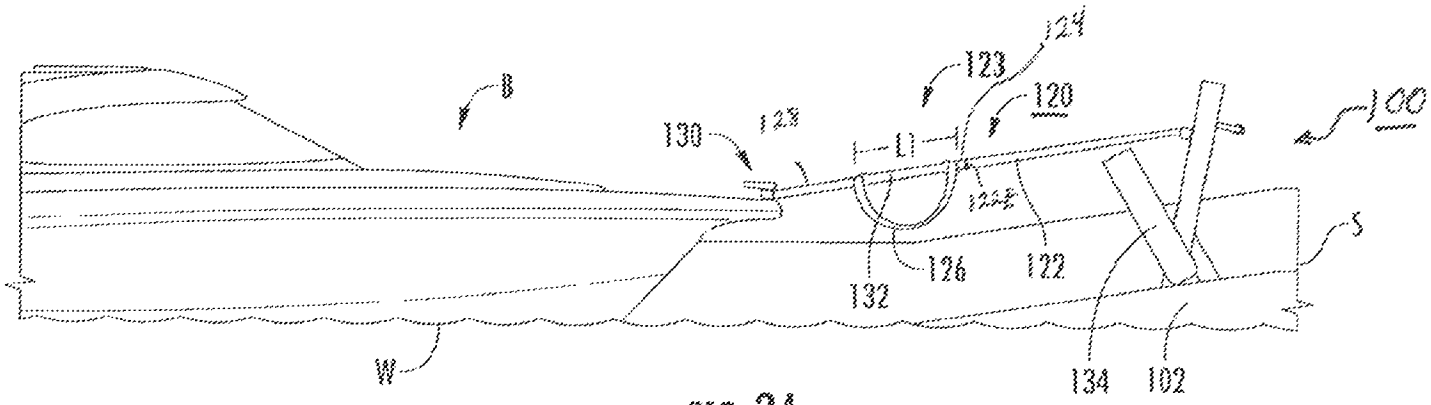
FIG. 3A is a front view of the boat tethering and launching system as shown in FIG. 2 with the boat tethering device in the first condition.
Figure 3B:
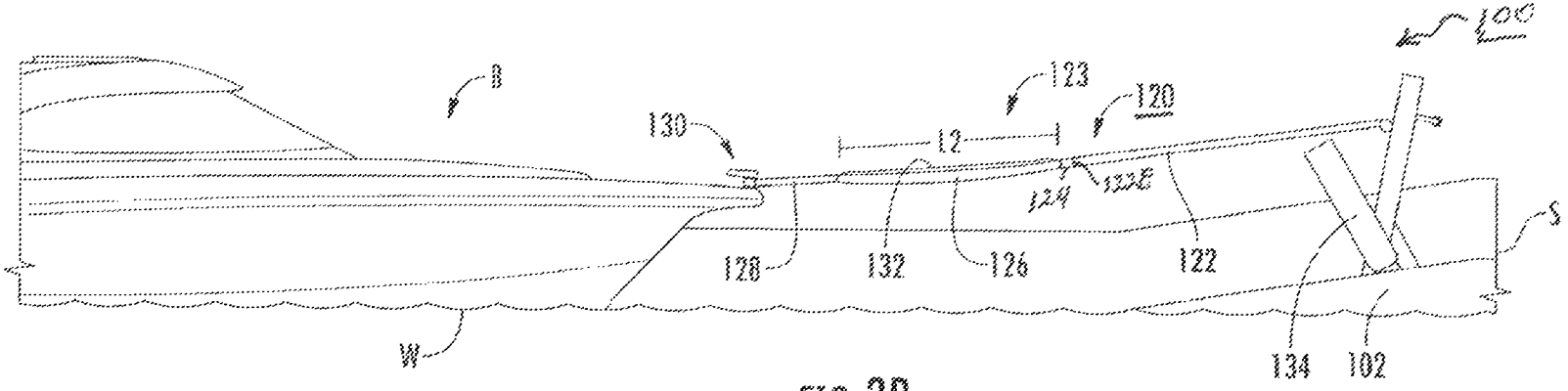
FIG. 3B is a front view of the boat tethering and launching system of FIG. 1 with the boat tethering device shown in a second condition.

A boat tethering and launching system and device will now be described with reference to FIGS. 1-3B.

As shown in FIGS. 1-3B, a boat tethering and launching system 100 may include a boat tethering and launching device 120. The system 100 may also include a ramp 102 that is configured to be angled downward from the shoreline in a direction toward and into the water W such that when a boat B or other maritime vehicle is positioned on the ramp, the force of gravity imparts a force to the boat B that directs it toward and into the water W and away from the shoreline S.

Advantageously and in contrast to the conventional art of mooring or tethering lines that have no 'give', that the launching device 120 may include a first longitudinally extending length of tethering material 122 and a second longitudinally extending length of tethering material 123. The first longitudinally extending length of tethering material 122 may include a first end that is configured to be secured to the ramp or another fixed point such as an upright brace 104 positioned relative to the shoreline S or other object. A second end 122E of the first longitudinally extending length of tethering material 122 may be secured or otherwise coupled to a second longitudinally extending length of tethering material 123.

The second longitudinally extending length of tethering material 123 may include a plurality of sections including a first section 124 that is secured to the second end 122*e* of the first length of tethering material 122, a second section 126, and a third section 128 that may be secured to a bow cleat 130 or the like that is coupled to the boat B, for example, via hook that is coupled to the third section 128.

The second section 126 of the second longitudinally extending length of tethering material 123 is disposed between the first section 124 and the third section 128. The second section 126 is coupled to a biasing member 132 such that opposing ends of the second section 126 are biased towards one another when the device 120 is not in use or when an axial load is not being applied, the opposing ends of the second section 126 a distanced apart by a distance L1 (FIG. 2A). However, when a load is applied, the opposing ends of the section 126 can maximally be spaced apart by a distance L2 corresponding to the length of the section 126.

Each of the first longitudinally extending length of tethering material, the second longitudinally extending length of tethering material, and the biasing members may have different moduli of elasticity such that they may have differing amounts of 'give' or elasticity or stretchability when an axial force or a pulling force is applied at ends thereof. As can be appreciated, it is desirable that a material have the ability to stretch rather than to snap or break when a pulling force is applied.

In an embodiment, the first longitudinally extending length of tethering material 122 may be formed from a rope material. The rope material of the first longitudinally extending length of tethering material 122 may be braided but may not be twisted such that the rope may very slightly stretch or lengthen when axial or pull forces are applied to ends thereof. In contrast, the second section 126 of the second longitudinally extending length of tethering material 123 may be formed from a nylon strap that has a high modulus of elasticity and resists being pulled or stretched. This is preferable as the biasing member 132 while having the ability to stretch may only be able to stretch so far prior to failing.

When used, the boat B may be positioned on the ramp 102 in an inclined positioned relative to the water. Any mooring lines or other means securing the boat B to the ramp 102 preventing relative movement of the boat B with respect to the ramp 102 may be released such that gravity will urge the boat B to translate along the ramp 102 and toward the water. In an initial state, the ends of the second section 126 may be spaced apart a distance L1 (FIG. 2A) as the biasing member 132 urges the two ends toward one another and may be spaced a maximum distance L2 apart in a fully stretched out condition (FIG. 2B).

When launching the boat B, the biasing member 132 may sufficiently resist being stretched such that the rate by which the boat B moves toward the water is controlled and not too quick. For safety, prior to the point at which the biasing member 132 might otherwise be stretched too far to the point of breaking, the second section 126 which may be formed from a nylon stretch that is both strong and lacking the ability to stretch would prevent the overstretching of the biasing member 132 and will also prevent the boat B from moving any further away from the shore S.

Advantageously, the device 120 in addition to assisting in the launching of the boat B may also facilitate mooring the boat B. According to the present disclosure, there is provided a biasing member or shock absorber 132 which controls and inhibits the boat from moving without stopping the boat and a section 123 that won't stretch preventing the over-extension of the biasing member 132 past a predetermined length. When moored, the biasing member 132 urges the device 120 to a shorter distance but permits the boat B to go further out. In choppy waters, where a boat B may move closer to and farther from the shore S, the biasing member 132 may dampen the stopping of the boat B which might otherwise come to an abrupt stop with more conventional mooring lines. That is, more conventional mooring lines only have a slackened state which exerts no forces upon the moored boat or a taut state which stops the boat.

A tubular housing 134 may be configured to store the boat tethering and launching device when not in use and may be secured to the ramp 102. Thus, when not in use, the device 120 may be conveniently stored.

Referring once again to FIG. 1, deployment of the device 120 out from the tubular housing 134 may be accomplished automatically as the boat B is being launched from the ramp 102 into the water W as indicated by directional arrow X. As the boat B moves in direction X, the device 120 is urged out form the tubular housing 134 causing the first longitudinally extending length of tethering material 122 to move in the direction indicated by directional arrow X and the and a third section 128 to move in an opposing direction Y until the device 120 is fully deployed from the tube 134. Advantageously, the automatic deployment from the housing 134 inhibits snagging or knotting of the device 120 that might otherwise occur if a length of tethering material were merely kept in a pile and was not gradually released form a housing free from structures that might otherwise catch the tethering material.

During use, it is recommended that your trailer has guide posts to hold your boat in position after launching. Alternatively, when not using guide posts, it may be recommended that the boat B be launched boat with a second person holding a dock line on the stern of the boat.

The tubular housing 134 may include a throughholes extending through the lateral surface into its interior. Tie wraps may be inserted through those throughholes such that the tubular housing may be secured to the ramp or trailer 102 in the position shown in FIG. 1, for example. Preferably, the tubular housing 134 may be secured to the trailer 102 at a 45 to 60 degree angle pointing at the boat, as seen below.

The launching device 120, may be secured at one end to the ramp 102 via hooks secured to opposing ends thereof and at the other end to the boat B, e.g., at the bow cleat of the boat B. Preferably, when launching the boat, a winch strap (not shown) if in use is detached. After having secured the launching device 120 to the boat B and to an object (e.g., a stationary object such as the ramp 102 with respect to the shore), the boat B may be launched. After launching the boat B, the launching device 120 may be used to tether or moor the boat B such that it functions as a dock line with a built in shock absorber by simply detaching the launch device 120 from the trailer and tying off on the cleat, which may be positioned on the dock or shoreline.

Having described at least one of the preferred embodiments of the present disclosure with reference to the accompanying drawings, it is to be understood that such embodiments are merely exemplary and that the disclosure is not limited to those precise embodiments, and that various changes, modifications, and adaptations may be effected therein by one skilled in the art without departing from the scope or spirit of the disclosure as defined in the appended claims. The scope of the disclosure, therefore, shall be defined solely by the following claims. Further, it will be apparent to those of skill in the art that numerous changes may be made in such details without departing from the spirit and the principles of the disclosure. It should be appreciated that the present disclosure is capable of being embodied in other forms without departing from its essential characteristics.

What is claimed is:

1. A boat tethering and launching system, comprising:

a boat tethering and launching device, comprising:

a first longitudinally extending length of tethering material having a first modulus of elasticity that is continuous along said first length of tethering material;

the first longitudinally extending length of tethering material having a first end and a second end;

a second longitudinally extending length of tethering material having a first end section secured to said second end of said first longitudinally extending length of tethering material, and a second middle section spacing a third end section opposite said first end section;

said second longitudinally extending length of tethering material having at least a second modulus of elasticity in said first end section, said second middle section, and said third end section;

said first modulus of elasticity of said first longitudinally extending length of tethering material being lower than said at least second modulus of elasticity of said second longitudinally extending length of tethering material in said first end section, said second middle section, and said third end section;

said second middle section of said second longitudinally extending length of tethering material having a first length spacing an opposed first-second middle section end and a second-second middle section end thereof;

a biasing member having a second length that is shorter than said first length of said second middle section of the second longitudinally extending length of tethering material;

said biasing member having an opposed first biasing member end and a second biasing member end;

said first biasing member end fixed to said first-second middle section end;

said second biasing member end fixed to said second-second middle section end;

the biasing member having a third modulus of elasticity;

said third modulus of elasticity being less than both said first modulus of elasticity and said second modulus of elasticity;

said biasing member biases said first end section to toward said third end section of said second longitudinally extending length of tethering material;

said first longitudinally extending length of tethering material is a non-twisted braided rope;

said second longitudinally extending length of tethering material is formed from nylon; and a tubular rigid housing that is open on a first end and closed on a second end and is configured to store said boat tethering and launching device.

* * * * *